US005308126A

United States Patent [19]

Weger, Jr. et al.

[11] Patent Number: 5,308,126

[45] Date of Patent: May 3, 1994

[54] PUSH-BUTTON LOCK SYSTEM

[75] Inventors: Kenneth F. Weger, Jr., Cary; Richard A. Koenig, Crystal Lake; Gerald A. Draffkorn, Jr., Crystal Lake; Steven J. Rogman, Crystal Lake; Jose R. Rodriquez, Marengo, all of Ill.

[73] Assignee: Knaack Manufacturing Company, Crystal Lake, Ill.

[21] Appl. No.: 583,582

[22] Filed: Sep. 17, 1990

[51] Int. Cl.[5] ..... E05C 3/22

[52] U.S. Cl. ..... 292/53; 70/DIG. 79; 292/DIG. 37; 292/DIG. 60; 292/48

[58] Field of Search ..... 292/DIG. 37, DIG. 44, 292/DIG. 60, 48, 47, 53, 29, 30, DIG. 43, 26; 70/DIG. 79, 360, 84

[56] References Cited

U.S. PATENT DOCUMENTS

| | | | |
|---|---|---|---|
| 2,399,812 | 5/1946 | Ledin | 70/84 |
| 2,468,644 | 4/1949 | Springer | 292/219 |
| 2,803,956 | 8/1957 | Womer | 70/84 |
| 2,839,912 | 6/1958 | Corbin et al. | 292/48 |
| 2,911,247 | 11/1959 | Corbin | 292/48 |
| 3,003,348 | 10/1961 | Jacobi | 70/84 |
| 3,860,276 | 1/1975 | Lambrecht | 292/DIG. 60 |
| 3,964,280 | 6/1976 | Kelton | 70/360 |
| 4,268,073 | 5/1981 | Hibbert | 292/113 |
| 4,630,852 | 12/1986 | White et al. | 292/DIG. 37 |

OTHER PUBLICATIONS

Knaack Manufacturing Co. product sheet, "Weather Guard Hi-Box Latch System," 1982.

Knaack Manufacturing Co. catalog, "Weather Guard," pp. 1-5 and 12, 1982.

*Primary Examiner*—Peter M. Cuomo

*Assistant Examiner*—Darnell M. Boucher

*Attorney, Agent, or Firm*—Leydig, Voit & Mayer, Ltd.

[57] ABSTRACT

A lock system for a container with a movable closure or lid. The lock system includes a pivotally mounted latch member, a corresponding rigid latch member which interlocks with the pivoting latch member when the closure is closed, and a push-button lock mechanism having a shoulder portion which engages and displaces the pivoting latch member, thereby permitting the closure to be opened, when the lock mechanism is in its "unlocked" position and the push-button is depressed. The pivoting latch member includes a pair of plates slideably coupled to one another, one pivotally mounted in the container and the other supporting a cross-member which engages the rigid latch member. The pivoting latch member has a slot through which the shoulder portion of the lock mechanism passes (without engaging or displacing the latch member) when the lock mechanism is "locked".

17 Claims, 4 Drawing Sheets

PUSH-BUTTON LOCK SYSTEM

TECHNICAL FIELD

The present invention relates generally to containers with movable closures and, more particularly, to a lock system for such containers.

BACKGROUND ART

Containers such as tool chests, boxes and cabinets typically have hinged movable closures (i.e., lids or doors) and some mechanism for locking the container to prevent loss or theft of items stored therein. These locking mechanisms have taken numerous mechanical configurations, including ones using push-button elements.

One such push-button lock system used previously in connection with containers has a rigid cross-member (such as a metal loop) welded or otherwise connected to the movable lid and a tang pivotally mounted on the container and spring biased to interlockingly engage the rigid cross-member when the lid is closed. A spring-biased push-button extends through a wall of the container in a location such that, when depressed, its inner surface impinges upon a portion of the tang and causes the tang to pivot and disengage from the cross-member, whereby the lid can be opened. A rotatable, cylindrical lock—having an inwardly projecting finger—also extends through the wall of the container substantially adjacent to the push-button. When the cylindrical lock is rotated to its "locked" position, the finger abuts a portion of the tang and prevents the tang from being pivoted by the push-button (i.e., prevents the tang and cross-member from disengaging).

This prior art push-button lock system is quite effective in preventing accidental and intentional unauthorized opening of containers, but is susceptible to damage (particularly the tang and the cross-member) upon forceful closing of the lid when the lock is in its "locked" position. Adjustment of the rigid cross-member to compensate for damage (i.e., bending of the tang or cross-member) is not easily accomplished in this lock system.

SUMMARY OF THE INVENTION

It is a primary object of the present invention to provide an improved lock system which is less susceptible to damage due to forceful closing of the lid.

It is another object of this invention to provide an improved lock system which can be easily and quickly adjusted to compensate for damaged latch elements.

A further object of this invention is to provide a lock system having a combination cylindrical lock and push-button.

Other objects and advantages of the invention will be apparent from the following detailed description.

In accordance with the present invention, there is provided a lock system for a container with a movable closure or lid. The lock system includes a pivotally mounted latch member, a corresponding rigid latch member which interlocks with the pivoting latch member when the closure is closed, and a push-button lock mechanism having a shoulder portion which engages and displaces the pivoting latch member, thereby permitting the closure to be opened, when the lock mechanism is in its "unlocked" position and the push-button is depressed. The pivoting latch member includes a pair of plates slideably coupled to one another, one pivotally mounted in the container and the other supporting a cross-member which engages the rigid latch member. The pivoting latch member has a slot through which the shoulder portion of the lock mechanism passes (without engaging or displacing the latch member) when the lock mechanism is "locked".

DESCRIPTION OF THE PREFERRED EMBODIMENTS

While the invention will be described in connection with particular preferred embodiments, it will be understood that it is not intended to limit the invention to those particular embodiments. On the contrary, it is intended to cover all alternatives, modification and equivalents as may be included within the spirit and scope of the invention as defined by the appended claims.

Figure 1:
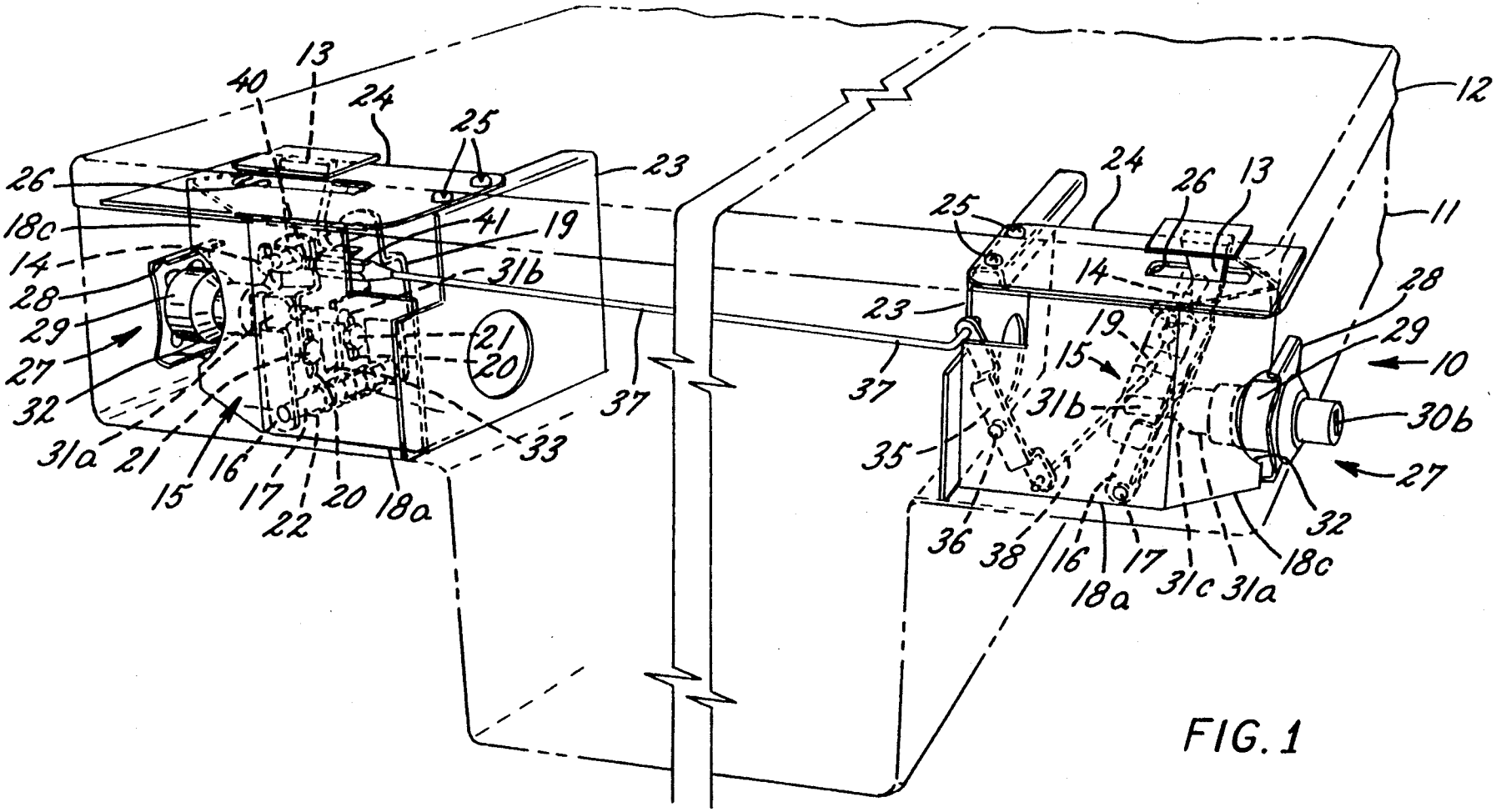
FIG. 1 is a perspective view, shown partially in phantom, of a push-button lock system embodying the present invention.
Figure 2:
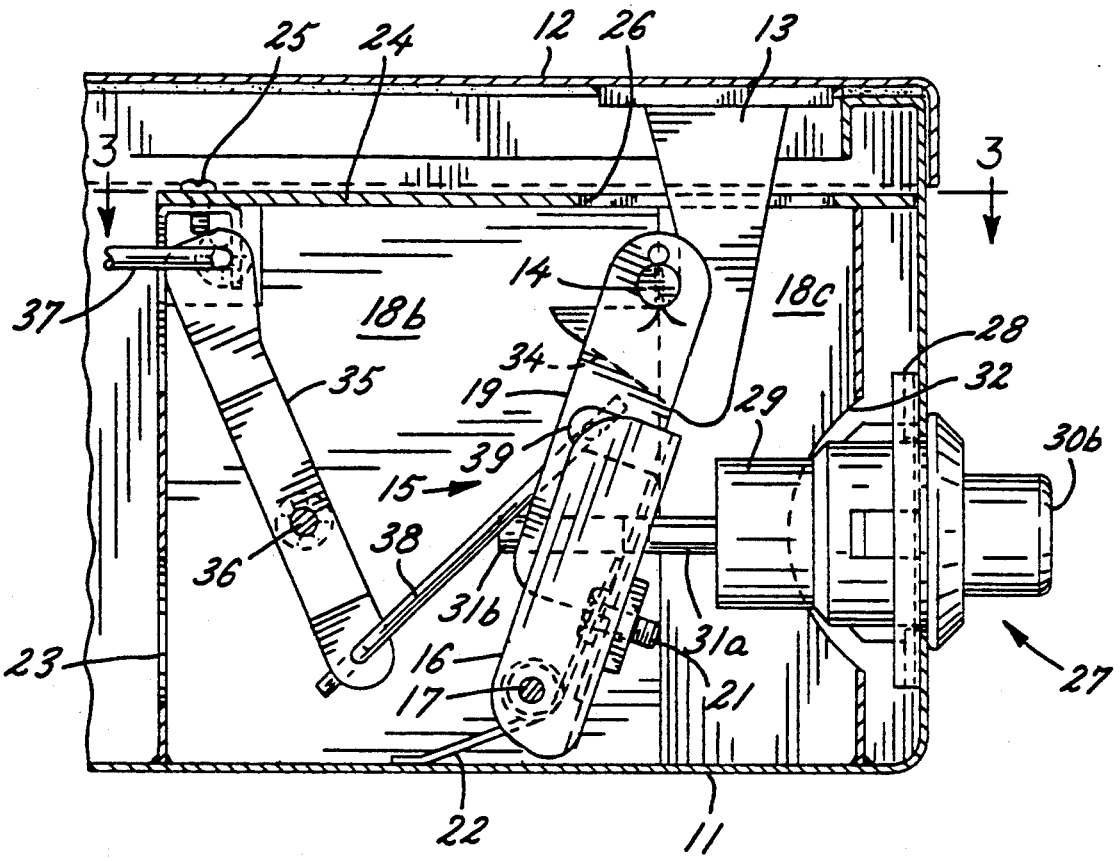
FIG. 2 is a side plan view of one of the latch mechanism/push-button combinations of the lock system shown in FIG. 1.
Figure 3:
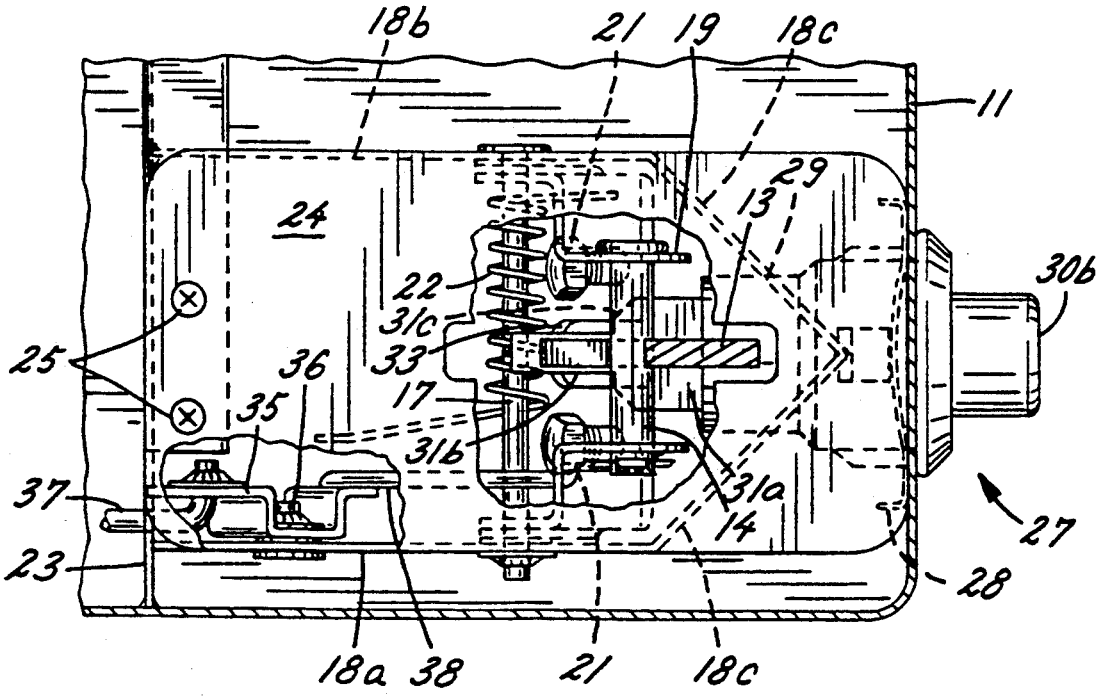
FIG. 3 is a sectional top plan view of the latch mechanism/push-button combination taken along the line 3—3 in FIG. 2.

Turning now to the drawings and referring first to FIGS. 1-3, there is shown generally a lock system 10 constructed in accordance with the invention for use with a container 11, such as a tool chest, box or cabinet, having a hinged closure (i.e., lid or door) 12. A rigid tang 13 is connected (such as by welding or other appropriate means) to the inside surface of the lid 12, extending downward therefrom and providing a catch for engaging a movable cross-member 14. The cross-member 14 is supported by a bracket 15 which is pivotally mounted in the container 11.

More specifically, the bracket 15 includes a base plate 16—which is mounted on a pivot rod 17 extending horizontally between a pair of housing walls **18*a*, 18*b* in the container 11—and an extension plate 19. Each of the plates 16, 19 preferably has integral edgewise flange portions—extending laterally to the substantially flat body portion—that define opposing members through which the pivot rod 17 and the cross-member 14 extend, respectively. The two plates at least partially overlie one another and have corresponding apertures (i.e., slots) 20 through which fasteners 21, such as threaded nut and bolt assemblies, are secured to couple the plates together. The slots 20 are configured such that, upon loosening the fasteners 21, the amount of overlap between the plates 16, 19 can be slideably adjusted, thereby adjusting the position of the cross-member 14** so as to ensure appropriate interlocking engagement with the tang 13.

A spring 22 is coiled about the pivot rod 17 with its free ends respectively bearing against a lower surface of the container 11 and the pivotally mounted bracket 15, thereby biasing the bracket in a predetermined direction. Tab members (not shown) are bent inward from the housing walls 18*a*, 18*b* in positions such as to provide stops against which the spring 22 maximally biases the bracket 15.

As can be readily appreciated from the foregoing description, the pivotally mounted bracket 15 is normally biased by the spring 22 such that when the lid 12 of the container 11 is closed the cross-member 14 supported by the bracket engages the tang 13 projecting downward from the lid (see FIG. 2). In that condition, the lid cannot be raised from its closed position unless force is applied which offsets the spring bias and displaces the bracket far enough to disengage the cross-member and the tang. To further protect cross-member 14 against damage, cross-member 14 may be rotatably mounted in bracket 15. By so mounting cross-member 14, should tang 13 contact cross-member 14 during closing, cross-member 14 is allowed to rotate in the bracket to thereby transfer at least a portion of the force of the contact to rotational energy and thus minimize the damaging effect of the impact. Moreover, cross-member 14 may be removably mounted as, for example, with the cotter pin assembly shown in FIG. 2, and may be replaced by a new cross-member if damaged or worn.

The bracket 15 is preferably enclosed by a housing assembly within the container 11 consisting of side walls 18*a*, 18*b*, an angled end wall 18*c*, a flat end wall 23—all of which are welded or otherwise permanently secured inside the container —and a top plate 24—which is removably secured by means of rivets or screws 25. The top plate 24 has a slot 26 through which the tang 13 passes. This housing assembly shields the bracket 15 from contact with tools or other items stored in the container which could damage or impair its pivoting motion and, furthermore, forms a deflection shield against prying instruments which might be used in an attempt to gain unauthorized access to the contents of the container.

A push-button lock mechanism 27 extends through and is connected by appropriate clips or other fastening means 28 to a wall of the container 11 adjacent to the pivotally-mounted bracket 15. This lock mechanism is of a commercially available cylindrical type, having a sleeve (i.e., annular) portion 29, which is fixed to the container wall through an aperture, and a piston portion 30 (see FIGS. 4–8) which fits inside the sleeve portion 29 and is slideably retained therein for relative movement into and out of the container. More specifically, the piston portion 30 of the lock mechanism 27 has an inner end 30*a* which extends inside the container and an outer key-insertion end 30*b* which is normally biased to extend to the outside of the container and form a push-button. Insertion and appropriate rotation of a key (not shown) in the key-insertion end 30*b* rotates the piston portion 30 within the sleeve portion 29 selectively between "locked" and "unlocked" positions. It should be noted, however, that the push-button 30*b* may be depressed regardless of whether the piston portion 30 is in its "locked" or "unlocked" position.

In accordance with an important aspect of the present invention, a shoulder mechanism is coupled to the inner end 30*a* of the piston portion of the lock mechanism. As shown in FIGS. 2–6, this shoulder mechanism includes a broad, flat section 31*a* adjacent the inner end of the piston portion and a narrow, axially-projecting tongue 31*b* at its distal end. The flat section 31*a* of the shoulder mechanism has tapered edges 31*c* adjacent to the tongue 31*b*. An aperture 32 is provided in the angled end wall 18*c* of the protective housing, through which the inner end 30*a* of the lock piston portion (and its attached shoulder mechanism 31*a*–31*c*) projects into close relation with the pivotally-mounted bracket 15.

The bracket 15 includes a central, vertically elongated slot 33 which is aligned with the longitudinal axis of the lock mechanism 27 and through which the tongue 31*b* of the shoulder mechanism extends. In accordance with the present invention, this slot 33 is dimensioned so as to let the flat section 31*a* of the shoulder mechanism pass through without engaging the bracket 15 when the piston portion 30 of the lock mechanism is in its "locked" position, but to not let the flat section 31*a* pass through when the piston portion 30 of the lock mechanism is in its "unlocked" position (see FIGS. 5 and 6). As shown in the preferred embodiment of FIGS. 1–6, the lock mechanism is "locked" when the flat section 31*a* of the shoulder mechanism is substantially vertical, and "unlocked" when the flat section is substantially horizontal. Of course, it will be appreciated that the opposite would be true in an embodiment of the invention in which the slot 33 through the bracket 15 is horizontally elongated.

Figure 4:
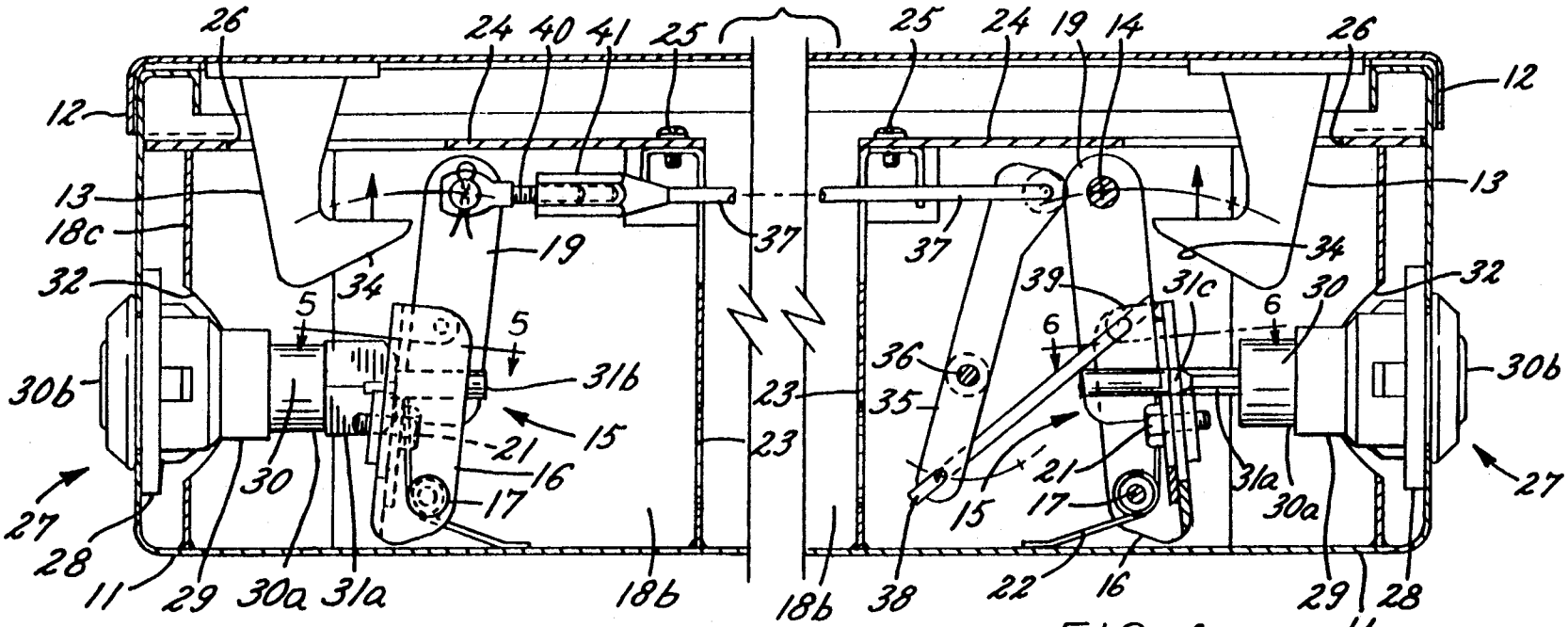
FIG. 4 is a side plan view of the entire push-button lock system shown in FIG. 1 with the push-buttons depressed.
Figure 6:
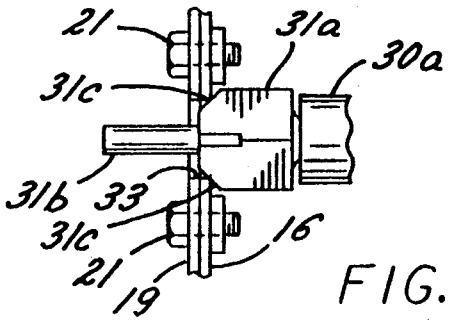
FIG. 6 is a top plan view taken along the line 6—6 in FIG. 4.

It can be readily appreciated from the foregoing description that when access to contents of the locked container is desired, a key is used to rotate the piston portion 30 of the lock mechanism 27 to its "unlocked" position and the push-button 30*b* is depressed. As depicted in FIGS. 4 (right half) and 6, this action drives the tapered edges 31*c* of the shoulder mechanism into abutment with bracket 15 (the slot 33 is too narrow for the shoulder to pass through). Full depression of the push-button pivotally displaces the bracket—against the spring bias—so that the tang 13 disengages from the cross-member 14 and the lid 12 can be raised. Upon release of the push-button, the spring 22 returns the bracket 15 to its normal position.

Figure 5:
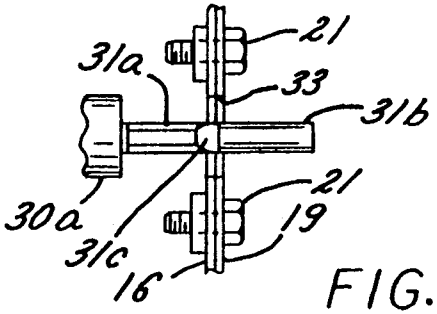
FIG. 5 is a top plan view taken along the line 5—5 in FIG. 4.

Of course, when the lock mechanism 27 is "locked", the push-button 30*b* can still be depressed, but the bracket 15 and tang 13 will not disengage because the flat section 31*a* of the shoulder mechanism is oriented vertically and merely passes through the vertical slot 33 in the bracket (see FIG. 5).

It can further be readily appreciated that the orientation in the inventive lock system of the bracket 15 for pivotal movement away from the shoulder mechanism on the lock protects the tang 13 and cross-member 14 against damage (i.e., bending) when the lid 12 of the container is forcefully closed from an open position, regardless of whether the lock is in its "locked" or "unlocked" position. In either the "locked" or "unlocked" condition, the bracket 15 is free to pivot as the sloped edge 34 of the tang 13 drives down on the cross-member 14 of the bracket. Once the bracket has pivoted far enough that the cross-member 14 clears the sloped edge 34 of the tang, the spring 22 returns the bracket to its normal position with the cross-member and tang engaged. The engagement of cross-member 14 in notch 44*a* resists movement of cross-member 14 away from tang 44 in the event the lid of the container is attempted to be lifted while the lock system is in the locked position, as may occur, for example, in attempts to pry open the lid of the container.

Depending upon the length and/or width of a container in which the inventive lock system is to be employed, it may be desirable to use a pair of latching mechanisms (i.e., bracket 15 and tang 13 combinations) at opposite ends of the container. In such instances, a push-button lock mechanism 27 is positioned adjacent to each latching mechanism and the two pivotally-mounted brackets 15 are mechanically coupled to one another so that the container can be opened by "unlocking" and depressing the push-button 30*b* of either of the two lock mechanisms. As shown in FIGS. 1–4, the mechanical coupling preferably consists of a stirrup 35 (which is pivotally mounted using a rivet or other appropriate fastener 36 to the housing side wall 18*a*), a first long tie rod 37 which extends between—and is swivel-connected to—one free end of the stirrup 35 and the cross-member 14 of one of the brackets 15, and a second shorter tie rod 38 which extends between—and is swivel-connected to—the other free end of the stirrup and an integral flange 39 projecting from the other bracket 15. With this coupling arrangement, it should be readily understood that when one of the brackets 15 pivots, the other also will pivot via swivel movement of the rigid tie rods 37, 38 and stirrup 35.

In a preferred embodiment (see FIGS. 1 and 4), the long tie rod 37 includes male and female threaded elements 40, 41 by means of which the tension between the two interconnected brackets 15 can be adjusted.

Figure 7:
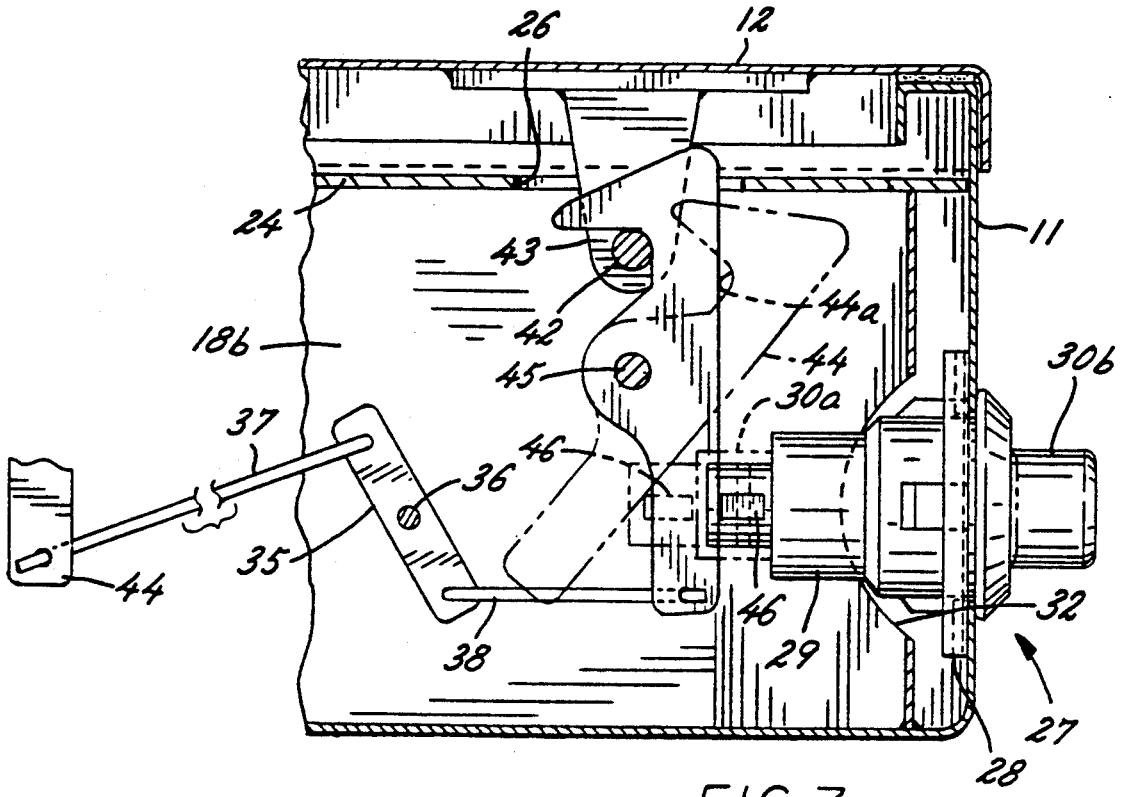
FIG. 7 is a side plan view of another push-button lock system embodying the present invention, illustrating the lock mechanism in its "unlocked" position.
Figure 8:
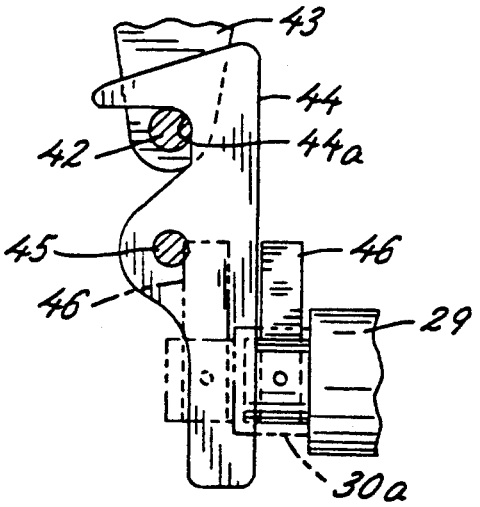
FIG. 8 is a side plan view of the lock system shown in FIG. 7, illustrating the lock mechanism in its "locked" position.

A second embodiment of the inventive lock system is shown in FIGS. 7 and 8. In this embodiment, a rigid cross-member 42 is fixed to the underside of the lid 12 by means of flanges 43 and a tang 44 having a notch 44*a* for engaging the cross-member 42 is pivotally mounted using well-known support structure (only the pivot rod 45 of which is shown) inside the container 11. In a preferred embodiment, bracket 15 engages tang 13 at such an angle that opening pressure exerted on the push button will tend to drive cross-member 14 upwardly out of tang 13 and relieve the bias of the spring against bracket 15 which facilitates unlocking. The preferred angle of engagement between the bracket 15 and tang 13 is approximately 30°. A spring (not shown) normally biases the tang 44 into interlocking engagement with the cross-member 42, thus preventing lifting of the lid 12 from its closed position.

A push-button lock mechanism 27 is provided which has substantially the same structure as the lock mechanism described above in connection with FIGS. 1–6, differing only in that a finger member 46 projects laterally from the inner end 30*a* of the lock piston portion instead of the above-described axially-extending shoulder mechanism 31*a*–31*c*. As depicted in FIG. 7, the finger member 46 is oriented horizontally when the lock mechanism is rotated by a key to its "unlocked" position. In this "unlocked" condition, the finger member will impinge on the tang 44 below the pivot rod 45 and, thereby, pivot the tang out of engagement with the cross-member 42 when the push-button 30*b* is depressed (shown in phantom in FIG. 7).

In contrast, when the lock mechanism is "locked" (i.e., the finger member is oriented vertically), the finger member will completely bypass the tang 44 when the push-button is depressed (shown in phantom in FIG. 8) due to lateral offset of the lock mechanism from the tang, and the tang and cross-member 42 will not disengage.

It can be readily appreciated that the embodiment of the inventive lock system depicted in FIGS. 7 and 8 could be modified by changing the physical orientation of the lock mechanism 27 with respect to the tang 44 such that the system would be "locked" when the finger member 46 extends horizontally and "unlocked" when the finger member extends vertically.

As can be seen from the foregoing detailed description, this invention provides an improved push-button lock system having a combination cylindrical lock and push-button. The lock system latching elements are not susceptible to damage due to forceful closing of the lid and, even if the latching elements should become damaged, they can be quite easily and quickly adjusted to compensate for the damage.

What is claimed is:

1. A lock system for a container with a closure that is movable between open and closed positions, said lock system comprising:

a first pair of latch members mounted, respectively, on the closure and on the inside of the container, one of which is pivotally mounted and biased into interlocking engagement with the other when the closure is closed, thereby preventing movement of the closure from the closed to the open position;

a first push-button lock mechanism mounted in a wall of the container and having a longitudinally slideable portion with an inner end that extends inside the container and an outer key-insertion end that is biased to the outside of the container and forms a push-button, said slideable portion being rotatable between locked and unlocked positions;

a first shoulder mechanism coupled to the inner end of the slideable portion which, only when the slideable portion is in its unlocked position and the push-button is depressed, impinges on the pivotally mounted latch member, counteracting the bias thereon and disengaging the pair of latch members, whereby movement of the closure to the open position is possible; and a second push-button lock mechanism having a second shoulder mechanism and a second associated pair of disengageable latch members, wherein the two pivotally mounted latch members are mechanically coupled to one another such that both pairs of latch members are disengaged when either of the push-button lock mechanisms is in the unlocked position and its push-button is depressed.

2. The lock system of claim 1, wherein one of the latch members comprises a tang which is rigidly mounted on the movable closure and the other latch member comprises a bracket which is pivotally mounted on the container and has a cross-member which interlockingly engages the tang to prevent movement of the closure form the closed to the open position.

3. The lock system of claim 2, wherein the pivotally mounted bracket has a slot therethrough which is longitudinally aligned with the shoulder mechanism, the slot and shoulder mechanism being configured such that the shoulder mechanism, upon depression of the push-button, passes through the slot without impinging on the bracket when the slideable portion of the lock mechanism is in its locked position, but does not fit through the slot and thereby impinges on the bracket and disengages the first pair of latch members when the slideable portion of the lock mechanism is in its unlocked position.

4. The lock system of claim 2, wherein the pivotally mounted bracket includes a base plate which is pivotally mounted on the container, an extension plate which supports the cross-member and is slideably coupled in overlaying relation to the base plate, and means for fastening the base and extension plates to one another so that the position of the cross-member can be adjusted to ensure appropriate interlocking engagement with the tang.

5. The lock system of claim 4, wherein the fastening means comprises at least one threaded assembly which extends through overlaying apertures in the base and extension plates, said apertures permitting slideable adjustment between the plates when the threaded assembly is loosened.

6. The lock system of claim 2 wherein said cross-member is rotatably mounted in said bracket.

7. The lock system of claim 6 wherein said tang includes a notch for engaging said cross-member.

8. The lock system of claim 7 wherein said bracket is enclosed by a housing assembly.

9. The lock system of claim 8 wherein said housing assembly comprises a pair of side walls, an angled end wall having a vertex in the proximity of the push-button mechanism and a cover.

10. The lock system of claim 1, wherein one of the latch members comprises a tang which is pivotally mounted on the container and the other latch member comprises a cross-member which is rigidly mounted on the closure, the tang being biased into interlocking relation with the cross-member when the closure is closed to prevent movement of the closure.

11. The lock system of claim 10, wherein the first shoulder mechanism comprises a pin which extends from, and substantially orthogonal to, the slideable portion of the first lock mechanism, said pin being positioned on the slideable portion such that it impinges on the pivotally mounted tang to counteract the bias thereon and disengage the tang and the cross-member only when the slideable portion is in the unlocked position and the push-button is depressed.

12. A lock system for a container with a closure that is movable between open and closed positions, said lock system comprising:

a first pair of latch members, one latch member comprising a tang which is rigidly mounted on the closure and the other comprising a bracket which is pivotally mounted on the container, has a cross-member and is biased such that the cross-member and tang interlockingly engage when the closure is closed, thereby preventing movement of the closure from the closed to the open position;

a first push-button lock mechanism mounted in a wall of the container and having a longitudinally slideable portion with an inner end that extends inside the container and an outer key-insertion end that is biased to the outside of the container and forms a push-button, said slideable portion being rotatable between locked and unlocked positions; and a first shoulder mechanism coupled to the inner end of the slideable portion;

wherein the pivotally mounted bracket has a slot therethrough which is longitudinally aligned with the shoulder mechanism, the slot and shoulder mechanism being configured such that the shoulder mechanism, upon depression of the push-button, passes through the slot without impinging on the bracket when the slideable portion of the lock mechanism is in its locked position, but does not fit through the slot and thereby impinges on the bracket, counteracts the bias thereon and disengages the first pair of latch members when the slideable portion of the lock mechanism is in its unlocked position, whereby movement of the closure to the open position is possible.

13. The lock system of claim 12, wherein the fastening means comprises at least one threaded assembly which extends through overlying apertures in the base and extension plates, said apertures permitting slideable adjustment between the plates when the threaded assembly is loosened.

14. the lock system of claim 12 wherein said cross-member is rotatably mounted in said bracket.

15. The lock system of claim 14 wherein said tang includes a notch for engaging said cross-member.

16. The lock system of claim 15 wherein said bracket is enclosed by a housing assembly.

17. The lock system of claim 16 wherein said housing assembly comprises a pair of side walls, an angled end wall having a vertex in the proximity of the push-button mechanism and a cover.

* * * * *

UNITED STATES PATENT AND TRADEMARK OFFICE

CERTIFICATE OF CORRECTION

PATENT NO. : 5,308,126

DATED : May 3, 1994

INVENTOR(S) : Kenneth F. Weger, Jr. et al.

It is certified that error appears in the above-identified patent and that said Letters Patent is hereby corrected as shown below:

In claim 2, at column 6, line 56, delete "form" and insert therefor --from--.

In claim 4, at column 7, line 5, delete "overlaying" and insert therefor --overlying--.

In claim 5, at column 7, line 12, delete "overlaying" and insert therefor --overlying--.

In claim 12, at column 8, line 6, after "position" insert --, the pivotally mounted bracket including a base plate which is pivotally mounted on the container, an extension plate which supports the cross-member and is slideably coupled in overlying relation to the base plate, and means for fastening the base and extension plates to one another so that the position of the

UNITED STATES PATENT AND TRADEMARK OFFICE

CERTIFICATE OF CORRECTION

PATENT NO. : 5,308,126

DATED : May 3, 1994

INVENTOR(S) : Kenneth F. Weger, Jr. et al

It is certified that error appears in the above-indentified patent and that said Letters Patent is hereby corrected as shown below:

cross-member can be adjusted to ensure appropriate interlocking engagement with the tang--.

Signed and Sealed this

Eighteenth Day of October, 1994

*Attest:*

*Attesting Officer*

BRUCE LEHMAN

*Commissioner of Patents and Trademarks*